United States Patent [19]

Eppe et al.

[11] 4,113,373

[45] Sep. 12, 1978

[54] COPYING APPARATUS

[75] Inventors: Rudolf Eppe, Taufkirchen; Günther Schnall, Eching; Ludwig Müllritter; Johann Beck, both of Munich; Karl Hartwig, Unterhaching, all of Fed. Rep. of Germany

[73] Assignee: Agfa-Gevaert AG, Leverkusen, Fed. Rep. of Germany

[21] Appl. No.: 699,341

[22] Filed: Jun. 24, 1976

[30] Foreign Application Priority Data

Jun. 28, 1975 [DE] Fed. Rep. of Germany ..... 2528925

[51] Int. Cl.[2] ..... G03G 15/28

[52] U.S. Cl. ..... 355/8; 355/71

[58] Field of Search ..... 355/3 R, 8, 11, 14, 355/71

[56] References Cited

U.S. PATENT DOCUMENTS

| | | | |
|---|---|---|---|
| 3,438,704 | 4/1969 | Schoen | 355/8 |
| 3,640,622 | 2/1972 | Shinozaki | 355/71 X |
| 3,724,940 | 4/1973 | Koizumi | 355/11 X |
| 3,724,942 | 4/1973 | Gibson et al. | 355/8 X |
| 3,771,867 | 11/1973 | Moser | 355/71 X |

*Primary Examiner*—William M. Shoop

*Attorney, Agent, or Firm*—Michael J. Striker

[57] ABSTRACT

A copying apparatus is disclosed wherein an original is scanned by a light beam which is then transmitted along a path to the photosensitive surface of an imaging drum. A pair of baffles is arranged symmetrically relative to the aforementioned path and a motion-transmitting arrangement is provided, which is controlled from outside the copying apparatus and which serves to synchronously pivot the baffles into and out of the path to thereby control the amount of light which reaches the photosensitive surface of the drum.

6 Claims, 4 Drawing Figures

RUDOLF EPPE
GÜNTHER SCHNALL
LUDWIG MÜLLRITTER
JOHANN BECK
KARL HARTWIG
by Michael J. Striker
Attorney

RUDOLF EPPE
GÜNTHER SCHNALL
LUDWIG MÜLLRITTER
JOHANN BECK
KARL HARTWIG

RUDOLF EPPE
GÜNTHER SCHNALL
LUDWIG MÜLLRITTER
JOHANN BECK
KARL HARTWIG
by Michael J. Striker
Attorney

COPYING APPARATUS

BACKGROUND OF THE INVENTION

The present invention relates to copying apparatus in general, and more particularly to the type of copying apparatus wherein an original to be copied is scanned and an image-forming light beam is then transmitted with the scanned information to an image-receiving surface. Xerographic copiers are exemplary of one type of such copying apparatus.

In apparatus of this kind it is often necessary to vary the amount of light which reaches the sensitized surface on which the image of the scanned original is to be formed. This is necessary for a variety of reasons, including the fact that different originals have different light-reflecting characteristics, dependent on which the copy being produced may become too light or too dark. It has been proposed to provide a baffle which is mounted adjacent the path of the light beam that travels from the original to the photosensitive surface, and to pivot this baffle into the path of the light beam to a greater or lesser extent, depending upon the correction that is to be made to compensate for the different reflection characteristics of the original, or for other reasons. However, this is not a satisfactory arrangement because the baffle enters the path of the light beam from one side and therefore influences the light beam asymmetrically. This disadvantageously influences the copy to be made, as will be evident to those conversant with this field.

SUMMARY OF THE INVENTION

Accordingly, it is an object of this invention to overcome the disadvantages of the prior art.

More particularly, it is an object of the present invention to provide an improved copying apparatus which avoids the aforementioned disadvantages.

In particular, it is an object of the invention to provide a copying apparatus of the type in question, wherein the control of the amount of light that reaches the photo-sensitive surface takes place by affecting the image-forming light beam symmetrically.

In keeping with the above objects, and with others which will become apparent hereafter, one feature of the invention resides in a copying apparatus which, briefly stated, comprises first means for supporting an original to be copied, second means having a photosensitive surface for receiving an image thereon, third means for scanning the original and transmitting an image-forming light beam from the first means along a path to the second means, and fourth means for varying the amount of light which reaches the aforementioned surface. The fourth means comprises a pair of baffles that are pivotally mounted symmetrically relative to the path of the light beam, and an arrangement for synchronously moving the baffles into and out of the path along which the light beam is transmitted.

An apparatus according to the present invention thus provides for an optically much more advantageous manner of controlling the amount of light reaching the photosensitive surface, than does the prior-art proposal.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

The invention will now be described on hand of FIGS. 1–4 with reference to a xerographic copying apparatus, although it is not limited to this particular type of copying apparatus.

Figure 1:
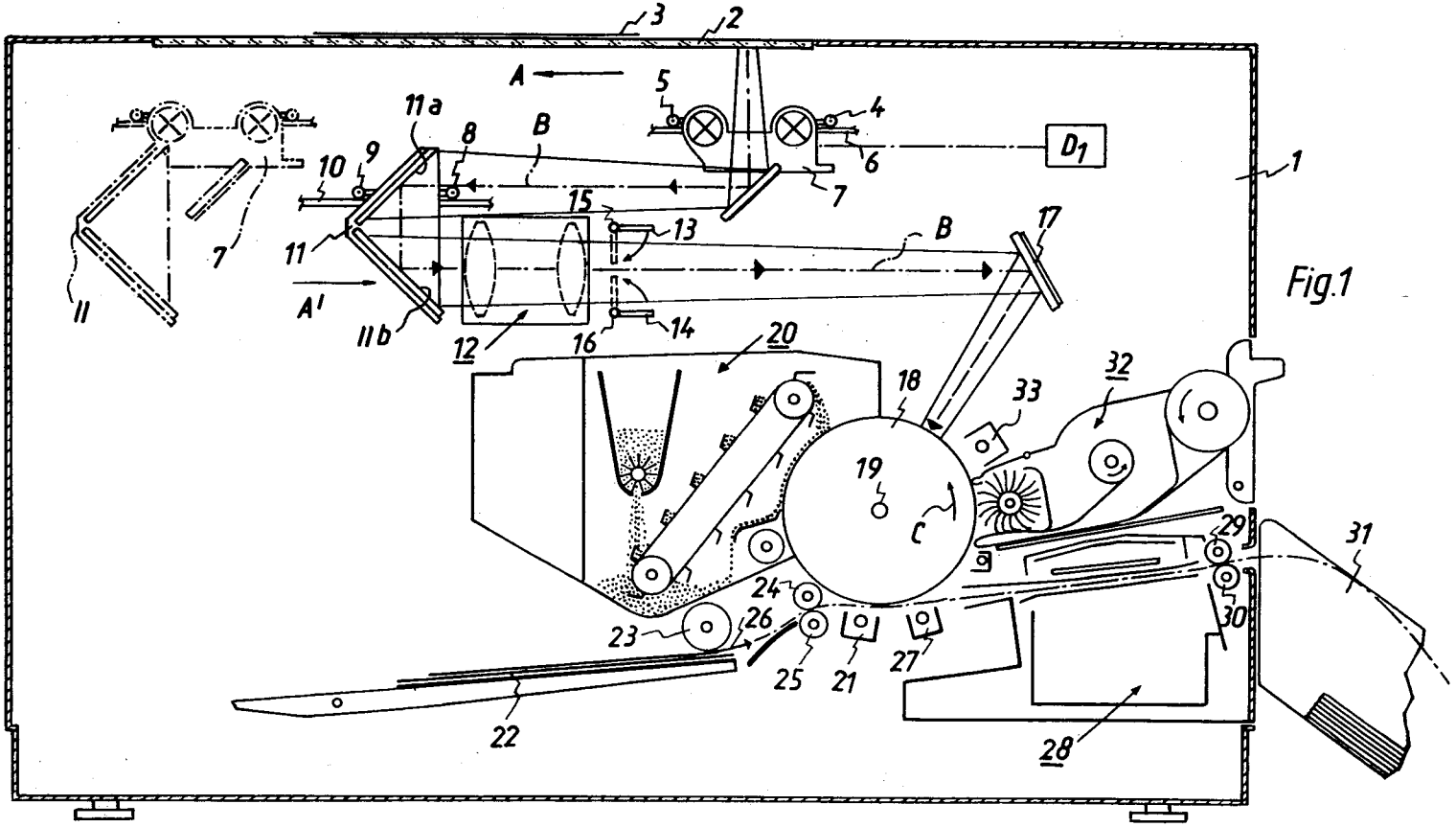
FIG. 1 is a diagrammatic, partially sectioned side view of an apparatus embodying the invention.

FIG. 1 shows such an apparatus to have a housing 1 which is provided with a transparent plate or support 2 of glass or transparent synthetic plastic material onto which an original 3 to be copied, for example a document, a print or the like, is placed when a copy is to be made. Beneath the transparent support 2 a scanning carriage 7 is mounted for movement on pairs of rollers 4 and 5 along guide rail 6, so as to scan successive strips of the surface area of the original 3 supported on the transparent support 2. The carriage 7 is driven by the diagrammatically illustrated drive D1 and advanced in the direction of the arrow A at a speed $v$. Coupled with the carriage 7 by means of a not illustrated but in this art conventionally used rope or cable transmission, is a carriage 11 which is movable along guide rails 10 (one shown) by means of pairs of rollers 8, 9 in the direction of the arrow A', and which moves in this direction at the speed $v/2$. The carriage 7 has a mirror 7a from which a light beam which scans the exposed surface of the original 3 — the surface which lies on the transparent support 2 — is reflected to two mutually inclined mirrors 11a and 11b carried by the carriage 11, so that the beam B is then further reflected to a stationarily mounted mirror 17. The travel of the carriage 11 in the direction of the arrow A' and at the speed $v/2$ serve to assure that the length of the path traversed by the beam B intermediate the scanned strips of the surface of the original 3 and the optical system 12 is maintained constant. The beam B, or rather the bundle of beams, is reflected by the mirror 17 onto the photoconductive layer formed on the surface of the imaging drum 18 which is rotatable — by a not illustrated drive — in the direction of the arrow C. The drum 18 rotates on the shaft 19 and is driven by the main drive motor (not shown) in synchronism with the scanning carriage 7.

As is conventional in xerographic copying apparatus, a charging station is provided in form of a charging corona 33 at which a uniform electrostatic charge is deposited on the photoconductive layer of the xerographic drum 18. Following thereafter, at the exposure station at which the beams B from the mirror 17 impinge the surface of the drum 18, a light or radiation pattern of the original to be reproduced is projected onto the drum surface in order to dissipate the drum charge in the exposed areas thereof, so as to form a latent electrostatic image of the copy — i.e. the original 3 — to be reproduced. During the continued rotation of the drum 18 in the direction of the arrow C the surface portion of the drum which now carries the latent electrostatic image reaches the developing station 20 at which a xerographic developing material, including toner particles having an electrostatic charge opposite to that of the electrostatic latent image, is cascaded over the drum surface, so that the toner particles adhere to the electrostatic latent image to form a xerographic powder image having the configuration of the original to be reproduced.

Arranged subsequently to the developing station 20 is a transfer station in form of a corona 21 at which the xerographic powder image is electrostatically transferred from the surface of the drum 18 onto a respective copy sheet 26 which is withdrawn from a stack 22 of such sheets by a feed roller 23 and forwarded in a path between the corona 21 and the drum 18 by a pair of cooperating nip rollers 24, 25 of which at least one is driven in rotation by a not-illustrated drive in the usual manner. The copy sheet 26 then is lifted off the surface of the drum 18 by a lift-off corona 27 and travels through an image fixing station 28 to be engaged by a pair of cooperating nip rollers 29, 30 of which at least one is driven by a not-illustrated drive, and to be discharged into the copy tray 31.

In the course of its continued rotation every part of the surface of the drum 18 then passes a cleaning station 32 at which the drum surface is brushed by the illustrated brush in order to remove residual toner particles remaining thereon after image transfer, and at which the drum surface is exposed to a relatively bright light to cause any residual electrostatic charge remaining on the xerographic surface of the drum 18 to become dissipated prior to renewed charging by the corona 33.

As was pointed out earlier herein, there are circumstances when it is necessary to adjust the amount of light which reaches the surface of the drum 18, i.e. to interfere with the beam or beams B by allowing more or less of the light of these beams to reach the surface of the drum 18. According to the present invention this is achieved by arranging downstream of the optical system 12 — i.e. intermediate the same and the mirror 17 — a pair of light control baffles 13, 14 which are mounted at opposite sides of the path in which the beam B travels to the mirror 17, i.e. which are located symmetrically with reference to that path. The baffles 13, 14 are pivotable about pivot axes 15, 16 and can be synchronously pivoted across this path from the solid-line position ultimately to the broken-line position or any position inbetween, in order to selectively and at the will of a user excise greater or lesser amounts of the light of the beam B.

Figure 2:
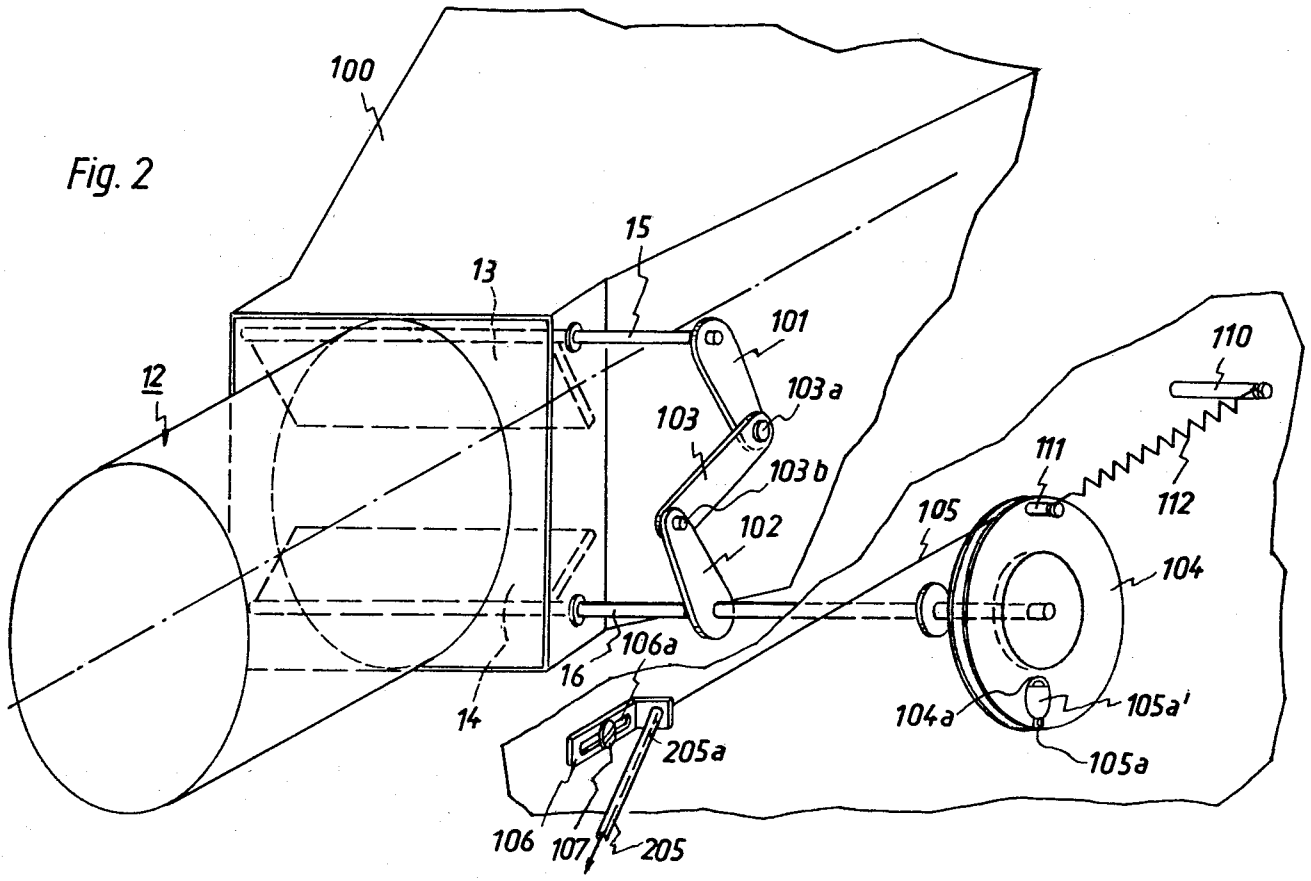
FIG. 2 is a fragmentary diagrammatic perspective, illustrating details of the baffles and the control for the same, as used in the embodiment of FIG. 1.

FIG. 2 shows details of this baffle arrangement. It will be seen that the optical system 12 is shown only diagrammatically, no attempt having been made to illustrate the lenses, in order to avoid confusion. Downstream of the optical system 12 is a light-guiding conduit or light shaft 100 in which the baffles 13 and 14 are located. Baffle 13 is pivotable about the pivot axis defined by the shaft 15 on which it is mounted for movement with but not relative to the shaft, and baffle 14 is similarly mounted for movement with but not relative to its associated shaft 16. The shafts 15 and 16 extend to the exterior of the conduit 100 and carry respective levers 101 and 102 each of which is fixedly connected with the respective shaft 15 and 16. The levers have their free ends coupled by a link 103 which is pivoted at **103*a* to the lever 101 and at 103*b* to the lever 102. Thus, rotational movement of one of the shafts 15, 16** and the corresponding movement of its associated baffle will result in synchronous movement of the other shaft and the associated baffle.

In particular, and as illustrated in FIG. 2, the shaft 16 extends beyond the lever 102 and carries a pulley 104 which is provided with an opening **104*a* having a narrow part and a wider part. Located in the wider part is an enlarged member 105*a* that is secured to the free end 105*a* of a cable 105 of a Bowden linkage. This cable 105 is trained about the periphery of the pulley 104 and passes into a tube or sheath 205 the end portion 205*a* of which is secured to one arm of an L-shaped bracket 106. This bracket has an elongated slot 106*a* in its other arm and a screw 107 extends through the slot 106*a* and secures the bracket 106 to a fixed part of the machine housing or machine frame. Shifting the bracket 106 lengthwise of the slot 106*a* after first loosening the screw 107 permits the Bowden linkage to be so adjusted that at a certain position of the setting knob described with reference to FIG. 3 the baffles 13, 14 will include between themselves an opening (e.g. the one shown in FIG. 2) corresponding to the average use requirements and from which they can be moved closer together to block out more of the light or can be moved farther apart to permit more of the light to pass between them. The pulley 104 and hence the shaft 16 and both baffles 13, 14, are permanently urged towards a rest position by means of a restoring spring 112 which has its opposite ends connected to a pin 111 on the pulley 104 and a pin 110** on a stationary part of the machine housing or frame.

Figures 3, 4:
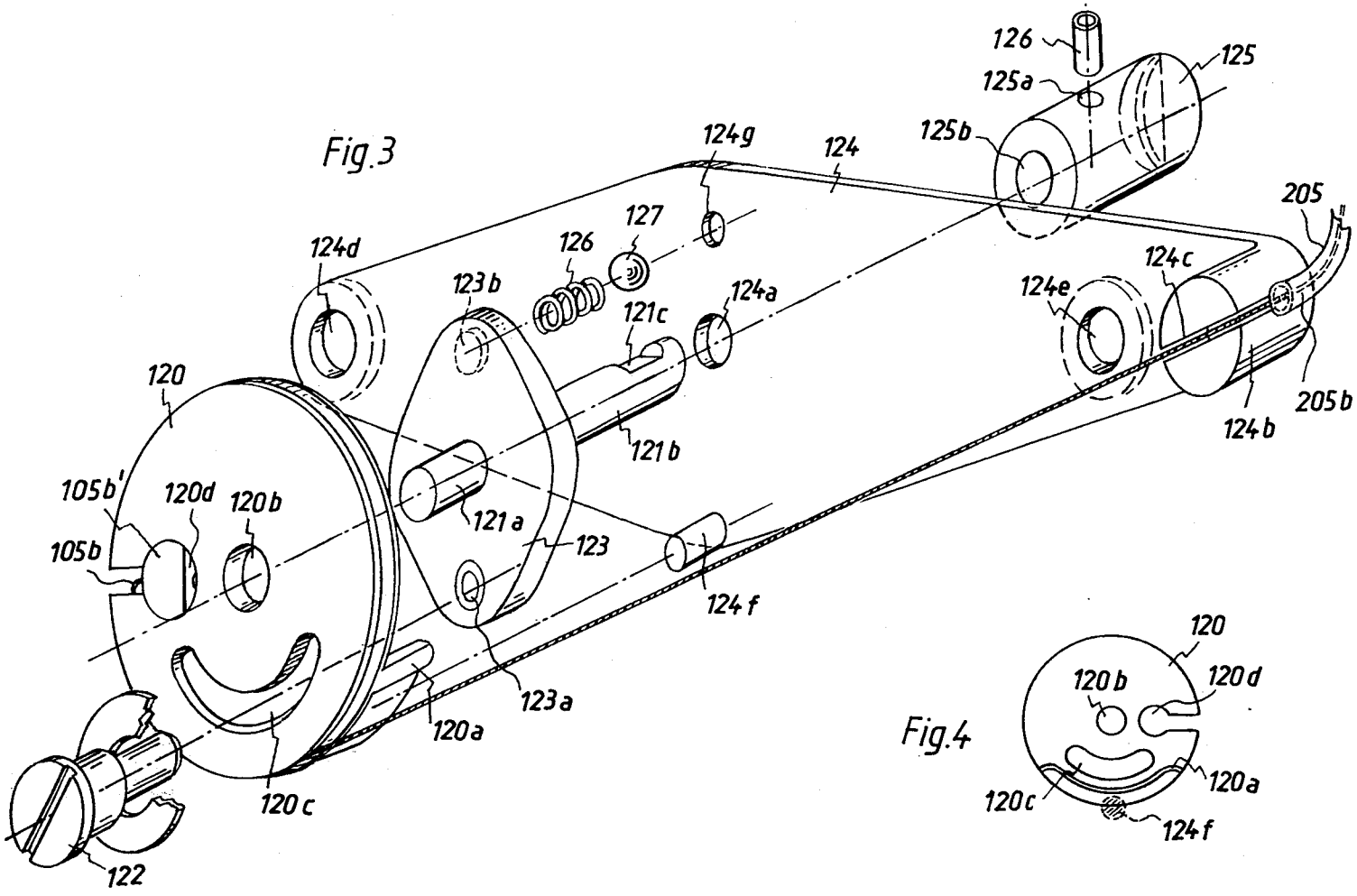
FIG. 3 is a fragmentary, exploded view illustrating details of the control for the baffles.
FIG. 4 is a front elevation of a component of FIG. 3.

FIG. 3 shows that the Bowden cable 105 extends through the sheath 205, leaving the same at the end portion **205*b* and being thereafter trained about the periphery of a further pulley 120. The pulley 120 is again provided with a hole 120*d* having a larger portion in which an enlarged end part 105*b*' of the free end 105*b* of the Bowden cable 105 is received so as to fix the cable to the pulley 120. The pulley has a center hole 120*b* in which a shaft portion 121*a* is received. Mounted on the shaft having the portion 121*a* is a plate-like member 123 beyond one side of which the shaft portion 121*a* extends, whereas a shaft portion 121*b* extends beyond the other side of the member 123. The pulley 120 is provided with an arcuate slot 120*c* through which a clamping screw 122 — e.g. with the illustrated spring-type retaining washer — extends and is threaded into a tapped bore 123*a* of the member 123. Thus, pulley 120 and member 123** are connected for joint rotation.

The shaft portion **121*b* extends through a hole 124*a* of a carrier 124 and has mounted on it a control knob 125 into a bore 125*b* of which it is inserted. The knob 125 is further provided with a tapped bore 125*a* which extends normal to the axis of the bore 125*b*. Shaft portion 121*b* is provided with a kerf or cutout 121*c* and a set screw 126 which is threaded into the bore 125*a* extends into this cutout 121*c* and locks the knob 125 to the shaft portion 121*b*** against both axial and rotational relative displacement.

As FIG. 3 shows, the support 124 is provided with a nose-like projection **124*b* formed with a slot 124*c* in which the end portion 205*b* of the sheath 205 is mounted. Carrier 124 is provided with bores 124*d* and 124*e* through which screws (not illustrated) extend in order to secure the support 124 to the machine housing 1 (not shown in FIG. 3, but compare FIG. 1), with a knob 125** being located at the exterior of the housing to be accessible to a user.

When the knob 125 is turned in one or the opposite direction through a certain angle, the pulley 120 is rotated through the same angle and via the Bowden linkage a corresponding motion is transmitted to the baffles 13, 14 so that the latter are either pivoted apart from their normal position, or pivoted closer towards one another to block out more light. The support 124 is provided with a pin **124*f* and the pulley 120 is provided with an arcuate abutment rib 120*a* (see FIG. 4 for the contour of the rib 120*a*) which cooperates with the pin 124*f* so that the latter delimits the angular range through which the knob 125 can turn the pulley 120. The arrangement is so chosen that in one end position of the knob 125 the baffles 13, 14 will assume the full-line end position shown in FIG. 1 and in the other end position of the knob 125 they will assume the broken-line end position shown in FIG. 1, whereas normally they may assume an intermediate position which corresponds, e.g. to that shown in FIG. 2**.

It is desirable that the intermediate position be precisely fixed, so that it can be reproduced at any time, i.e. it can be chosen at will and in a simple manner. For this purpose the member 123 is provided on its side facing away from the pulley 120 with a blinde bore **123*b* in which a helical spring 126 is in part received. The spring 126 presses a spherical ball 127 into a bore 124*g* formed in the support 124. Thus, when the knob 125 is used to turn the member 123 and the pulley 120 either in one direction or in the other direction, the ball 127 will leave the bore 124*g* which is, of course, only large enough for it to enter partially and not for it to pass through, and will travel to one side or the other side of the bore 124*g* in an arcuate path. The ball 127 of course cannot escape since the member 123 is closely located to the surface of the support 124 in which the bore 124*g* is formed. When the knob 125 is subsequently turned back again in the opposite direction, the ball 127 will snap into the bore 124*g*** to provide a pronounced indication that the center position or normal position has again been reached.

This center position is set by loosening the screw 107 and shifting the mounting bracket 106 with its slot **106*a* relative to the screw 107 until the desired setting for the baffles 13, 14 has been reached. If for any reason, e.g. over a period of time, the operating parameters of the copying apparatus change, and if this necessitates resetting of the optimum intermediate position of the baffles 13, 14, then the optimum position can be newly set in a simple manner by turning the knob 125 to the intermediate position in which the ball 127 snaps into the bore 124*g*, whereupon the screw 122 is released or loosened, the pulley 120 is turned relative to the member 123 within the range made possible by the elongation of the arcuate slot 120*c* until the desired relative position of the baffles 13, 14 has been reached, and thereupon the screw 122 is again tightened. It is worthwhile mentioning here that this readjustment could also be made by shifting the bracket 106 rather than adjusting the pulley 120 relative to the member 123. However, as a general rule the bracket 106 will be less readily accessible in the interior of the apparatus than will be the pulley 120 which can be located — together with the support 124 — at a variety of locations where it will be much more readily accessible to the service technician. Therefore, it is preferred to effect the adjustment via the pulley 120** but it should be understood that this is not the only way in which the adjustment can be carried out.

The novel copying apparatus is susceptible of many changes and modifications which will be readily apparent to those skilled in the art and which are intended to protect it by the appended claims. For example, the shafts 15, 16 need not be located in a common plane, i.e. in a plane which passes through the axis of the two shafts. Thus, one of the baffles could be located farther downstream of the path of the light beams B than the other baffle if this were desired. The pulleys 104 and 120 might be replaced with other members capable of performing the same function. In place of the single bore **124*g*** a plurality of bores might be provided, for instance three of them of which one would correspond to an indication for the normal operating position, one would correspond to an indication for the one end position in which the baffles are completely withdrawn from the path of the light beams, and another would correspond to the opposite end position in which the baffles are completely pivoted into the path of the light beams. The invention is of course usable not only with xerographic copying apparatus, although it has been illustrated employed in such apparatus for purposes of explanation. Other copying apparatus wherein the same problem which is solved with the invention, also exists, can also make use of the inventive concept. Also, the baffles need not be pivotable but could, e.g. be made to slide across the path from mutually opposite sides.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A copying apparatus, comprising first means for supporting an original to be copied; second means having a photosensitive surface for receiving an image thereon; third means for scanning said original and transmitting image-forming light beams from said first means along a path to said second means; and fourth means for varying the amount of light which reaches said surface, comprising a pair of baffles pivotally mounted symmetrically relative to said path, and means for synchronously moving said baffles into and out of said path along which said light beams are transmitted, including a control member accessible exteriorly of said apparatus for selectively moving said baffles, and a Bowden linkage interconnecting said control member and said baffles, said Bowden linkage comprising a Bowden line and a sheath surrounding the same over part of the length thereof, said sheath having two end portions; and further comprising means arrestably mounting one of said end portions on said apparatus for displacement relative to the other end portion of a plurality of positions.

2. A copying apparatus, comprising first means for supporting an original to be copied; second means having a photosensitive surface for receiving an image thereon; third means for scanning said original and transmitting image-forming light beams from said first means along a path to said second means; and fourth means for varying the amount of light which reaches said surface, comprising a pair of baffles pivotally mounted symmetrically relative to said path, and means for synchronously moving said baffles into and out of said path along which said light beams are transmitted, including a control member accessible exteriorly of said apparatus for selectively moving said baffles, and a Bowden linkage interconnecting said control member and said baffles, said control member being rotatable about an axis, and said moving means further comprising a pulley mounted for rotation about said axis, said Bowden linkage comprising a Bowden line having an end portion trained about said pulley and fixedly connected thereto.

3. A copying apparatus as defined in claim 2, wherein said moving means further comprises adjusting means interposed between and cooperating with said control member and baffles for adjusting the position of said baffles relative to one another and to said path.

4. A copying apparatus as defined in claim 2; further comprising means for varying the angular position of said pulley relative to said axis.

5. A copying apparatus as defined in claim 4, said moving means comprising a shaft which defines said axis, and a plate mounted on said shaft for rotation therewith; and said varying means comprising an arcuate slot in said pulley and a clamping screw extending through said slot and threaded into said plate.

6. A copying apparatus, comprising first means for supporting an original to be copied; second means having a photosensitive surface for receiving an image thereon; third means for scanning said original and transmitting image-forming light beams from said first means along a path to said second means; and fourth means for varying the amount of light which reaches said surface, comprising a pair of baffles pivotally mounted symmetrically relative to said path, and means for synchronously moving said baffles into and out of said path along which said light beams are transmitted, said moving means comprising two turnable shafts each mounting one of said baffles, an arm mounted on each shaft extending transversely of the elongation of the respective shaft, for turning with the same and having a free end portion, and a link having opposite ends each pivoted to one of said end portions so that turning of one of said shafts results in synchronous displacement of both of said baffles.

* * * * *